US010239329B2

(12) United States Patent
Niu

(10) Patent No.: US 10,239,329 B2
(45) Date of Patent: Mar. 26, 2019

(54) FABRIC PRINT MEDIUM

(71) Applicant: Hewlett-Packard Development Company, L.P., Houston, TX (US)

(72) Inventor: Bor-Jiunn Niu, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 516 days.

(21) Appl. No.: 14/906,379

(22) PCT Filed: Sep. 20, 2013

(86) PCT No.: PCT/US2013/060845
§ 371 (c)(1),
(2) Date: Jan. 20, 2016

(87) PCT Pub. No.: WO2015/041666
PCT Pub. Date: Mar. 26, 2015

(65) Prior Publication Data
US 2016/0159107 A1 Jun. 9, 2016

(51) Int. Cl.
*B41J 3/407* (2006.01)
*B41M 5/00* (2006.01)
(Continued)

(52) U.S. Cl.
CPC ..... *B41J 3/4078* (2013.01); *B41M 5/00* (2013.01); *B41M 5/0017* (2013.01);
(Continued)

(58) Field of Classification Search
CPC ..... B41J 3/4078; B41M 5/00; B41M 5/508; B41M 5/52; B41M 5/0017; B41M 5/5218;
(Continued)

(56) References Cited

U.S. PATENT DOCUMENTS 4,309,179 A 1/1982 Heuser et al.
6,207,258 B1 * 3/2001 Varnell ..... B41M 5/0017 428/32.1
(Continued)

FOREIGN PATENT DOCUMENTS

CN 1265625 9/2000
CN 1488672 4/2004
(Continued)

OTHER PUBLICATIONS

International Search Report and Written Opinion for International Application No. PCT/US2013/060845 dated Jun. 26, 2014, 12 pages.

*Primary Examiner* — Cephia D Toomer
(74) *Attorney, Agent, or Firm* — HP Inc. Patent Department

(57) ABSTRACT

A fabric print medium containing a fabric base substrate and a coating composition applied to the fabric base substrate. The coating composition includes a non-halogenated flame retardant agent having phosphorous-containing ingredient and nitrogen-containing ingredient at a 1:1 ratio, a water-soluble polymer binder and a water-soluble high-valence metal complex. Also disclosed are the method for making such fabric print medium and the method for producing printed images using said material.

20 Claims, 1 Drawing Sheet

(51) Int. Cl.

| | |
|---|---|
| ***B41M 5/50*** | (2006.01) |
| ***B41M 5/52*** | (2006.01) |
| ***D06P 5/00*** | (2006.01) |
| ***D06P 5/30*** | (2006.01) |
| ***D06M 11/57*** | (2006.01) |
| ***D06M 13/282*** | (2006.01) |
| ***D06M 13/285*** | (2006.01) |
| ***D06M 13/288*** | (2006.01) |
| ***D06M 13/292*** | (2006.01) |
| ***D06M 23/08*** | (2006.01) |
| ***D06P 1/48*** | (2006.01) |
| ***D06P 1/52*** | (2006.01) |
| ***D06P 1/667*** | (2006.01) |
| ***D06P 1/673*** | (2006.01) |

(52) U.S. Cl.
CPC ..... *B41M 5/508* (2013.01); *B41M 5/52* (2013.01); *B41M 5/5218* (2013.01); *D06M 11/57* (2013.01); *D06M 13/282* (2013.01); *D06M 13/285* (2013.01); *D06M 13/288* (2013.01); *D06M 13/292* (2013.01); *D06M 23/08* (2013.01); *D06P 1/48* (2013.01); *D06P 1/5228* (2013.01); *D06P 1/5285* (2013.01); *D06P 1/667* (2013.01); *D06P 1/67366* (2013.01); *D06P 1/67375* (2013.01); *D06P 5/001* (2013.01); *D06P 5/30* (2013.01); *B41M 5/5227* (2013.01); *B41M 5/5254* (2013.01); *B41M 5/5281* (2013.01); *D06M 2200/30* (2013.01); *D06P 5/00* (2013.01)

(58) Field of Classification Search
CPC ..... B41M 5/5227; B41M 5/5254; B41M 5/5281; D06P 5/001; D06P 5/30; D06P 5/00; D06P 1/48; D06P 1/5228; D06P 1/5285; D06P 1/667; D06P 1/67366; D06P 1/67375; D06M 11/57; D06M 13/282; D06M 13/285; D06M 13/288; D06M 13/292; D06M 23/08; D06M 2200/30
See application file for complete search history.

(56) References Cited

U.S. PATENT DOCUMENTS

| | | | |
|---|---|---|---|
| 6,326,323 | B1 | 12/2001 | Shimano et al. |
| 6,670,001 | B2 | 12/2003 | Kohsaka |
| 6,939,583 | B2 | 9/2005 | Katsuki et al. |
| 2002/0013391 | A1 | 1/2002 | Huusken |
| 2003/0077959 | A1 | 4/2003 | Cates et al. |
| 2005/0277711 | A1 | 12/2005 | Takahata et al. |
| 2008/0081160 | A1 | 4/2008 | Anderle et al. |
| 2009/0280706 | A1 | 11/2009 | Craamer et al. |
| 2009/0298368 | A1* | 12/2009 | Craamer ..... D06M 11/64 442/79 |
| 2011/0169901 | A1 | 7/2011 | Pinto et al. |
| 2012/0224818 | A1 | 9/2012 | Karayianni |
| 2013/0040131 | A1 | 2/2013 | Sugino et al. |

FOREIGN PATENT DOCUMENTS

| | | |
|---|---|---|
| CN | 1780528 | 5/2006 |
| EP | 0855462 | 7/1998 |
| EP | 2233634 | 9/2010 |
| JP | 2001194674 | 7/2001 |
| JP | 2002321452 | 11/2002 |
| JP | 2006016897 | 1/2006 |
| KR | 100651634 | 11/2006 |
| WO | WO 99/06219 | 2/1999 |
| WO | WO 2009/034394 | 3/2009 |
| WO | WO-2009157952 | 12/2009 |

* cited by examiner

FABRIC PRINT MEDIUM

BACKGROUND

Inkjet printing technology has expanded its application to large format high-speed, commercial and industrial printing, in addition to home and office usage, because of its ability to produce economical, high quality, multi-colored prints. This technology is a non-impact printing method in which an electronic signal controls and directs droplets or a stream of ink that can be deposited on a wide variety of medium substrates. Inkjet printing technology has found various applications on different substrates including, for examples, cellulose paper, metal, plastic, fabric, and the like. The substrate plays a key role in the overall image quality and permanence of the printed images. However, when printing on fabric substrates, challenges exist due to the specific nature of fabric. Accordingly, investigations continue into developing fabric medium substrates that can be effectively used and which impart good image quality and durability for example.

BRIEF DESCRIPTION OF THE DRAWINGS

The drawings illustrate various examples of the present print medium and are part of the specification.

DETAILED DESCRIPTION

Figure 1:
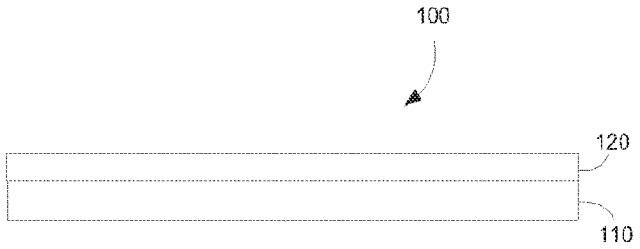
FIGS. 1 and 2 are cross-sectional views of the fabric print medium according to examples of the present disclosure.

Before particular examples of the present disclosure are disclosed and described, it is to be understood that the present disclosure is not limited to the particular process and materials disclosed herein. It is also to be understood that the terminology used herein is used for describing particular examples only and is not intended to be limiting, as the scope of protection will be defined by the claims and equivalents thereof. In describing and claiming the present article and method, the following terminology will be used: the singular forms "a", "an", and "the" include plural referents unless the context clearly dictates otherwise. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. All percentages are by weight (wt %) unless otherwise indicated. As used herein, "image" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

The present disclosure refers to a fabric print medium including a fabric base substrate and a coating composition, applied to the fabric base substrate, which includes a non-halogenated flame retardant agent having phosphorous-containing ingredient and nitrogen-containing ingredient compounded at a 1:1 ratio; a water-soluble polymer binder and a water-soluble high-valence metal complex. The present disclosure also relates to a method for forming said fabric print medium and to the printing method using said fabric print medium.

When printing of fabric substrates, challenges exist due to the specific nature of fabric. Indeed, often, fabric does not accurately receive inks. Some fabrics, for instance, can be highly absorptive, diminishing color characteristics, while some synthetic fabrics can be crystalline, decreasing aqueous ink absorption leading to ink bleed. These characteristics result in the image quality on fabric being relatively low. Additionally, black optical density, color gamut, and sharpness of the printed images are often poor compared to images printed on cellulose paper or other media types. Durability, such as rubbing resistance, is another concern when printing on fabric, particularly when pigmented inks and ink compositions containing latex are used. Furthermore, when fabric is intended to be used in close proximity to indoor environments (as drapes, as overhead signage, as part of furnishings, or the like), there are concerns about flame resistance as well as about using coatings that increase the flammability of the fabric. Thus, fire/flame resistance or inhibition characteristics are also desirable when providing printable fabrics.

The image printed on the fabric print medium of the present disclosure (i.e. which is treated by a coating composition including a non-halogenated flame retardant agent having phosphorous-containing ingredient and nitrogen-containing ingredient compounded at a 1:1 ratio; a water-soluble polymer binder and a water-soluble high-valence metal complex), exhibits excellent printing qualities and durability. By using such coating composition, in combination with the fabric print medium, the printing process is more accurate and the printed image is more permanent. The resultant printed fabric will also have good water resistance properties while providing fire/flame resistance or inhibition to the fabric.

The present disclosure refers to a fabric print medium comprising a fabric base substrate and a coating composition applied to said fabric base substrate. The coating composition includes a non-halogenated flame retardant agent having phosphorous-containing ingredient and nitrogen-containing ingredient compounded at a 1:1 ratio; a water-soluble polymer binder and a water-soluble high-valence metal complex. Without being linked by any theory, it is believed that the coating composition, also called treatment composition, once applied on the fabric base substrate, forms a thin layer onto the fabric base surface. Said thin layer has a first structure before image formation on the fabric (e.g., using inkjet printing for example) and a second different structure once the ink has been applied. The first structure is configured to allow ink colorants to adhere better onto the structure. The first structure formed from the treatment composition is transformed into a second structure, during printing process, to further protect the image after image formation. In some examples, the fabric base substrate has two sides, and both of the two sides are coated with the coating composition.

Figure 2:
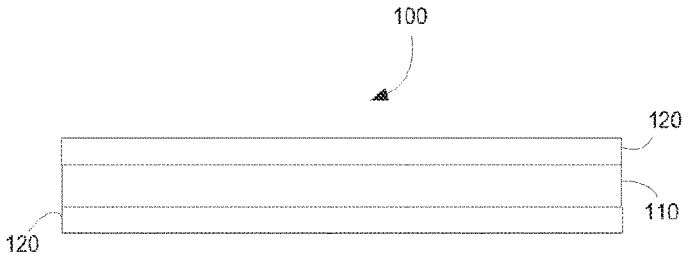
Figure 3:
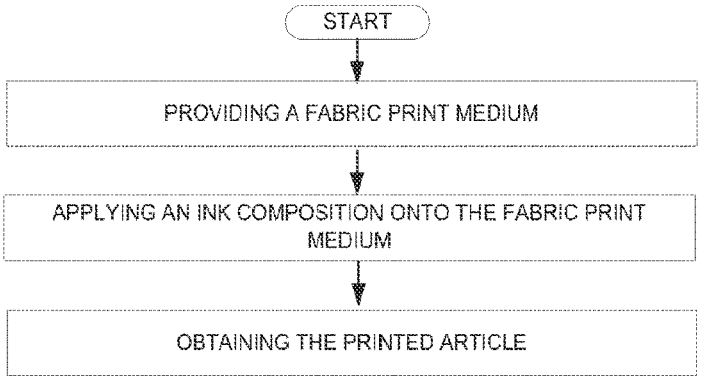
FIG. 3 is a flowchart illustrating the method for producing images according to some examples of the present disclosure.

FIG. 1 and FIG. 2 illustrate the fabric print medium (100) as described herein. As illustrated in FIG. 1, the fabric print medium (100) encompasses a fabric base substrate (110) and a coating composition or layer (120). The coating composition (120) is applied on one side of the bottom supporting substrate (110). If said coated side is used as an image-receiving side, the other side, i.e. backside, may not have any coating at all, or may be coated with other chemicals (e.g. sizing agents and backing adhesives) or coatings, or laminate with other materials such as backing paper and plastic film/sheet to meet certain features such as to balance the curl of the final product or to improve sheet feeding in printer. In some other examples, such as illustrated in FIG. 2, the coating composition (120) is applied to both opposing sides of the supporting fabric base substrate (110). The double-side coated media has thus a sandwich structure, i.e. both sides of the fabric base substrate (110) are coated with the same coating and both sides may be printed. An example of the printing method in accordance with the principles described herein, by way of illustration and not limitation, is shown in FIG. 3. FIG. 3 illustrates examples of the printing method that encompasses providing a fabric print medium, applying an ink composition onto said a print medium and obtaining a printed article.

The amount of the coating composition (120) on the fabric base substrate in the dry state is, at least, sufficient to hold all of the ink that is to be applied to the print medium. The fabric base substrate (110) can have a thickness along substantially the entire length ranging between about 0.025 mm and about 0.5 mm. In some examples, the coating composition (120) is disposed on the fabric base substrate (110) and forms a coating layer having a coat-weight in the range of about 0.1 to about 40 gram per square meter ($g/m^2$ or gsm) per side, or in the range of about 0.5 gsm to about 30 gsm, or in the range of about 3 to about 20 gsm, or in the range of about 5 to about 15 gsm per side.

The Fabric Base Substrate

Regarding the fabric base substrate, any textile, fabric material, fabric clothing, or other fabric product where there is a desire for application of printed matter can benefit from the principles described herein. More specifically, fabric substrates useful in present disclosure include substrates that have fibers that may be natural and/or synthetic. The term "fabric" as used to mean a textile, a cloth, a fabric material, fabric clothing, or another fabric product. The term "fabric structure" is intended to mean a structure having warp and weft that is one of woven, non-woven, knitted, tufted, crocheted, knotted, and pressured, for example. The terms "warp" and "weft" refers to weaving terms that have their ordinary means in the textile arts, as used herein, e.g., warp refers to lengthwise or longitudinal yarns on a loom, while weft refers to crosswise or transverse yarns on a loom. It is notable that the term "fabric substrate" does not include materials commonly known as any kind of paper (even though paper can include multiple types of natural and synthetic fibers or mixture of both types of fibers). The paper thereon is defined as the felted sheet, roll and other physical forms which are made of various plant fibers (like trees or mixture of plant fibers) with synthetic fibers by laid down on a fine screen from a water suspension. Furthermore, fabric substrates include both textiles in its filament form, in the form of fabric material, or even in the form of fabric that has been crafted into finished article (clothing, blankets, tablecloths, napkins, bedding material, curtains, carpet, shoes, etc.).

In some examples, the fabric base substrate is woven, knitted, non-woven or tufted and comprises natural or synthetic fibers selected from the group consisting of wool, cotton, silk, rayon, thermoplastic aliphatic polymers, polyesters, polyamides, polyimides, polypropylene, polyethylene, polystyrene, polytetrafluoroethylene, fiberglass, polycarbonates polytrimethylene terephthalate, polyethylene terephthalate and polybutylene terephthalate. In some other examples, the fabric base substrate is a synthetic polyester fiber.

The fabric base substrate can be a woven fabric where warp yarns and weft yarns are mutually positioned at an angle of about 90°. This woven fabric includes, but is not limited to, fabric with a plain weave structure, fabric with twill weave structure where the twill weave produces diagonal lines on a face of the fabric, or a satin weave. The fabric base substrate can be a knitted fabric with a loop structure including one or both of warp-knit fabric and weft-knit fabric. The weft-knit fabric refers to loops of one row of fabric are formed from the same yarn. The warp-knit fabric refers to every loop in the fabric structure that is formed from a separate yarn mainly introduced in a longitudinal fabric direction. The fabric base substrate can also be a non-woven product, for example a flexible fabric that includes a plurality of fibers or filaments that are one or both of bonded together and interlocked together by a chemical treatment process (e.g., a solvent treatment), a mechanical treatment process (e.g., embossing), a thermal treatment process, or a combination of two or more of these processes.

The fabric base substrate can include one or both of natural fibers and synthetic fibers. Natural fibers that may be used include, but are not limited to, wool, cotton, silk, linen, jute, flax or hemp. Additional fibers that may be used include, but are not limited to, rayon fibers, or those of thermoplastic aliphatic polymeric fibers derived from renewable resources, including, but not limited to, corn starch, tapioca products, or sugarcanes. These additional fibers can be referred to as "natural" fibers. In some examples, the fibers used in the fabric base substrate includes a combination of two or more from the above-listed natural fibers, a combination of any of the above-listed natural fibers with another natural fiber or with synthetic fiber, a mixture of two or more from the above-listed natural fibers, or a mixture of any thereof with another natural fiber or with synthetic fiber.

The synthetic fiber that may be used in the fabric base substrate can be a polymeric fiber including, but not limited to, polyvinyl chloride (PVC) fibers, PVC-free fibers made of polyester, polyamide, polyimide, polyacrylic, polypropylene, polyethylene, polyurethane, polystyrene, polyaramid (e.g., Kevlar®) polytetrafluoroethylene (Teflon®) (both trademarks of E. I. du Pont de Nemours Company), fiberglass, polytrimethylene, polycarbonate, polyethylene terephthalate or polybutylene terephthalate. In some examples, the fibers include a combination of two or more of the above-listed polymeric fibers, a combination of any of the above-listed polymeric fibers with another polymeric fiber or with natural fiber, a mixture of two or more of the above-listed polymeric fibers, or a mixture of any of the above-listed polymeric fibers with another polymer fiber or with natural fiber. In some examples, the synthetic fiber includes modified fibers from above-listed polymers. The term "modified fibers" refers to one or both of the polymeric fiber and the fabric as a whole having underwent a chemical or physical process such as, but not limited to, one or more of a copolymerization with monomers of other polymers, a chemical grafting reaction to contact a chemical functional group with one or both the polymeric fiber and a surface of the fabric, a plasma treatment, a solvent treatment, for example acid etching, and a biological treatment, for example an enzyme treatment or antimicrobial treatment to prevent biological degradation.

In some examples, the fabric base substrate contains both natural fiber and synthetic polymeric fiber. The amount of synthetic polymeric fibers can represent from about 10% to about 90% of the total amount of fiber. The amount of natural fibers can represent from about 10% to about 90% of amount of fiber.

The fabric base substrate may further contains additives including, but not limited to, one or more of colorant (e.g., pigments, dyes, tints), antistatic agents, brightening agents, nucleating agents, antioxidants, UV stabilizers, fillers and lubricants, for example. Alternatively, the fabric base substrate may be pre-treated in a solution containing the substances listed above before applying the coating composition. The additives and pre-treatments are included in order to improve various properties of the fabric.

The Coating Composition

The coating composition (120), applied to the fabric base substrate (110), is based on a treatment composition that includes at least a non-halogenated flame retardant agent having phosphorous-containing ingredient and nitrogen-containing ingredient at a 1:1 ratio; a water-soluble polymer binder and a water-soluble high-valence metal complex. Other functional additives can be added to the coating composition, for specific property control such as, for examples, optical brightener agent, optical brightener agent carrier, dyes for color hue, surfactant for wettability, and processing control agent such as deformer, and PH control base/acid buffer.

The Flame Retardant Agent

The coating composition that is applied to the fabric base substrate encompasses a flame retardant agent. Said flame retardant agent is non-halogenated and includes phosphorus-containing ingredient and nitrogen-containing ingredient compounded at a 1:1 ratio. The wording "1:1 ratio" refers herein to the fact that the phosphorus-containing ingredients and nitrogen-containing ingredients are present in the same proportions in the structure of the flame retardant agent. The wording "non-halogenated" refers to the fact that the flame retardant agent does not contain any halogenated elements.

The flame retardant agents, or flame inhibitors, or fire resistant ingredients, refer to any substance that has the effect of reducing flammability or inhibiting the combustion of the fabric medium. While the fire/flame retardant agents provide the function of reducing flammability and inhibiting combustion, some flame retardant agents impact the ink adhesion to the fabric base substrate adversely. Such impact could reduce the durability of printed image. To balance said controversial effects, specific flame retardant agents are present in the coating composition. The non-halogenated flame retardant agent of the present disclosure is in a liquid state and is compatible with aqueous solvent in the ambient temperature.

The flame retardant agent can be present, in the fabric print medium, in an amount representing more than 2 wt % by total weight of the fabric print medium. In some examples, the amount of flame retardant agent can be within the range of about 2 to about 10 wt % by total weight of the fabric print medium. In some other examples, the flame retardant agent is present, in the coating composition, in an amount representing from about 40 to about 90 wt % of the total weight of the coating composition. In yet some other examples, the flame retardant agent is present in an amount representing from about 50 to about 80 wt % of the total weight of the coating composition Phosphorus-containing ingredients (or phosphorus ingredients) include organic and inorganic phosphates, phosphonates, and/or phoshphinates with different oxidation states are effective for use. In some examples, the phosphorus-containing ingredient is an organic phosphorus-containing ingredient. In some other examples, the phosphorus-containing ingredients can be an organic organophosphonate with four oxygen atoms attached to the central phosphorus; an aliphatic, aromatic, or polymeric organophosphate with 3 oxygen atoms attached to the central phosphorus, or an organophosphinate with 2 oxygen atoms attached to the central phosphorus atom. Formula I below provides a general formula for an organophosphate, Formula II sets forth an organophosphonate that can be aliphatic organophosphonate, an aromatic organophosphonate, or an organophosphonate polymer; and Formula III provides a formulaic example of organophosphinates.

Formula I

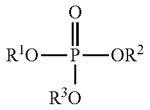

Formula II

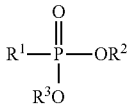

Formula III

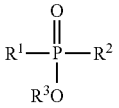

In Formula I, II and III; $R^1$, $R^2$, and $R^3$ are individually organic or inorganic substituents that can be different or the same, including $C_1$-$C_{12}$ branched or straight chained alkyl, aryl, and bisphosphate. Specific examples of organophosphates include diphenyl-phosphate (TPP), resorcinol bis (diphenylphosphate) (RDP), bisphenol A diphenyl-phosphate (BADP), tricresyl-phosphate (TCP); dimethyl-phosphonate, 2,2-Oxybis[5,5-dimethyl-1,3,2-dioxaphosphorinane]2,2-disulphide, bisphenol-A-bis (diphenyl-phosphate)diethyl-phosphonate, diethylphosphinate aluminum salt, dimethyl-propyl-phosphonate, diethyl N,N-bis(2-hydroxyethyl), aryl-phosphates, cresyl diphenyl-phosphate (diphenyl-tolyl-phosphate); cyclic phosphonate; diethyl-ethyl phosphonate, dimethyl-methyl-phosphonate; diphenyl (2-ethylhexyl) phosphate or the like.

Nitrogen-containing ingredients (or nitrogen ingredients), that are part of the non-halogenated flame retardant agent; include melamines (including melamine derivatives) such as melamine cyanurate, melamine polyphosphate, amidourea, amidodiurea, melem and melon. In some examples, the nitrogen-containing ingredients are melamine and melamine related molecules. Di-melamine orthophosphate, melamine modified ammonium polyphosphate can also be used as examples of nitrogen-containing ingredients.

Examples of non-halogenated flame retardant agent with phosphorus-containing ingredients and nitrogen-containing ingredients, at a 1:1 ratio, include APP (ammonium polyphosphate), PDSPB (poly (4,4-diaminodiphenyl methane spirocyclic pentaerythritol bisphosphonate)), DTPAB (1,4-di(diethoxy thiophosphamide benzene), aminomethyl phosphonate, ethylenediamine-o-phosphate, modified guanidine phosphate, melamine phosphate, melamine polyphosphate, melamine-poly(ammonium) phosphate and mixtures thereof. In some examples, the non-halogenated flame retardant agent, having phosphorus-containing ingredients and nitrogen-containing ingredients compounded at a 1:1 ratio, is selected from the group consisting of APP, PDSPB, DTPAB, aminomethyl phosphonate, ethylenediamine-o-phosphate, modified guanidine phosphate, melamine phosphate, melamine polyphosphate and melamine-poly(ammonium) phosphate. In some other examples, the non-halogenated flame retardant agent contains a methylphosphonic acid [$(CH_3)PO(OH)_2$] as a phosphorous-containing ingredient and an amidourea group [$(NH_2)(NH)CO(NH_2)$] as a nitrogen-containing ingredient.

Examples of the non-halogenated flame retardant agent includes also Aflammit® MSG (available from Thor Ltd.), or FR-305 (from Hangzhou Fairland Chemical Technology Co.) an aqueous mixture based on phosphorus and nitrogen organic ingredients.

Water-Soluble Polymer Binders

The coating composition, which is applied to the fabric base substrate, includes water-soluble polymer binders. In some examples, said water-soluble polymer binders are aqueous based or water-soluble polyurethane polymers. The term "water-soluble polymer binder" is meant herein to include any hydrophilic or hydrophilic/hydrophobic blend of polymer material that can be used to bind particulates together to form a coating in accordance with examples of the present disclosure. The water-soluble polymer binder can include ingredients which can form a continuous film and can have strong binding power to the fabric substrate, such as natural or synthetic macromolecule compounds.

The water-soluble polymer binders can be present, in the print medium, in an amount representing more than 2 wt % by total weight of the fabric print medium. In some examples, the amount of water-soluble polymer binder can be within the range of about 2 to about 10 wt % by total weight of the fabric print medium. In some other examples, the water-soluble polymer binders are present, in the coating composition, in an amount representing from about 2 to about 30 wt % of the total weight of the coating composition. In yet some other examples, the water-soluble polymer binders are present in an amount representing from about 5 to about 20 wt % of the total weight of the coating composition.

The water-soluble polymer binder can be polyurethane, synthetic polymers such as polyvinyl alcohol and polyvinyl acetate or nature polymers such as starches and chemically modified starches. In some examples, the water-soluble polymer binder is selected from the group consisting of polyurethane, polyvinyl alcohol, polyvinyl acetate, starches and chemically modified starches. In some other examples, the water-soluble polymer binder is a polyurethane polymer. In yet some other examples, the water-soluble polymer binder is modified polyacrylate or polymethacrylte. Modified polyacrylate includes copolymers of acrylic with methacrylic, acrylic acid, styrene and anhydride.

The water-soluble polymer binder (or film-forming polymers) can be formed by polymerization of organic monomers, inorganic monomers, and hybrids of organic and inorganic monomers. In some examples, an organic polymer such as polyurethane or polyacrylate can be grafted with some inorganic units such as halogen groups, e.g., bromides, fluorides, and chlorides, phosphorus groups, and/or nitrogen groups.

Suitable water-soluble polymers can also include ingredients such as polyvinyl alcohol, starch derivatives, gelatins, cellulose derivatives, and acrylamide polymers. The polymeric binder can be a polyvinylalcohol or a copolymer of vinylpyrrolidone. The copolymer of vinylpyrrolidone can include various other copolymerized monomers, such as methyl acrylates, methyl methacrylate, ethyl acrylate, hydroxyethyl acrylate, hydroxyethyl methacrylate, ethylene, vinylacetates, vinylimidazole, vinylpyridine, vinylcaprolactams, methyl vinylether, maleic anhydride, vinylamides, vinylchloride, vinylidene chloride, dimethylaminoethyl methacrylate, acrylamide, methacrylamide, acrylonitrile, styrene, acrylic acid, sodium vinylsulfonate, vinylpropionate, and methyl vinylketone, etc. The copolymer of vinylpyrrolidone can be a copolymer of vinylpyrrolidone and vinylacetate or vinylcaprolactam or polyvinylalcohol. The polyvinylalcohol or copolymer of vinylpyrrolidone can have a weight average molecular weight ranging from about 10,000 Mw to about 1,000,000 Mw or can have a weight average molecular weight ranging from about 20,000 Mw to about 500,000 Mw. In some examples, the binder is a polyvinylalcohol having a molecular length in the range of 20,000 to 500,000. Examples of water-soluble binders may include, for example, a polyvinyl alcohol sold under the trade name Mowiol® 6-98 (available from Kuraray America, Inc.), and 2-hydroxyethyl starch ether sold under the tradename of Penford® Gum 280 (available from Penford Products Co).

Other representative examples of such water-soluble polymer binder include citrate or sebacate compounds, ethyoxy alcohols, glycol oligomer and low molecular weight polymers, glycol ether, glycerol acetals, surfactants having a more than 12 carbon backbone (anionic, cationic or non-ionic), and cyclic amide like lactams such as β-lactam, γ-lactam, and δ-lactam, and mixtures thereof. In certain examples, the latex ink film-forming agent can be a cyclic amide like lactam, such as β-lactam, γ-lactam, and δ-lactam, or mixtures thereof. In certain other examples, the latex ink film-forming aid can be a γ-lactam. Representative examples of a γ-lactams include N-methyl-2-pyrrolidone, 5-methyl-2-pyrrolidone, polyvinylpyrrolidone and 2-pyrrolidone.

The water-soluble polymer binder can be available under the tradename PrintRite® DP376, DP350, DP351, DP675, DP261, DP218E, Hycar® 26172 (all available from Lubrizol) or under the tradename Raycat® 78 (available from Specialty Polymers Inc.).

Water-Soluble High-Valence Metal Complex

The coating composition that is applied to the fabric base substrate includes a water-soluble high-valence metal complex. Such water-soluble high-valence metal complex can be a water-soluble compound containing high-valence metallic ion, a water-soluble cationic high-valence metallic complex or a water-soluble cationic polymeric compounds containing high-valence metallic ion. Water-soluble high-valence metallic ions can be high-valence metallic cation or anion. Suitable cation species can include one or more of Group II metals, Group III metals or transition metals from the period table, such as, for instance, calcium, copper, nickel, zinc, magnesium, barium, iron, aluminum and chromium ions. Anion species can include one or more of chloride, iodide, bromide, nitrate, sulfate, sulfite, phosphate, chlorate, and acetate. In some examples, the water-soluble high-valence metal complex is a water-soluble aluminum salt. In some other examples, the water-soluble high-valence metal complex is a water-soluble trivalent aluminum salt. Examples of such salts include aluminum acetate, aluminum bromate, aluminum bromide and the hexa- and pentadecyl hydrates thereof, aluminum ammonium sulfate, aluminum sodium sulfate, aluminum chlorate, aluminum citrate, aluminum chlorohydrate, aluminum chloride and the hexahydrate thereof, aluminum fluoride, aluminum iodide and the hexahydrate thereof, aluminum lactate, aluminum nitrate, aluminum stearate, aluminum sulfate, aluminum tartrate, aluminum triformate, aluminum formo-acetate and the hydrate.

The water-soluble high-valence metal complex can be a water-soluble cationic high-valence metallic complex. Such water-soluble cationic high-valence metallic complex can be a charged complex ion derived from a metal complex with coordinate covalent bonds or dative covalent bonds. The coordination number is defined by the number of ligand(s) attached to the central metal ion, and may range from two to nine, or even more. The ligands can be small polar molecules, such as $H_2O$ and $NH_3$, or can be anions such as $Cl^-$, $OH^-$ and $S^{2-}$. Examples of water-soluble high-valence metal complexes include $[Al(H_2O)_6]^3$, $[Al(H_2O)_3(OH)_3]$, $[Al(H_2O)_2(OH)_4]$, and $[Al(H_2O)_4(OH)_2]$. Other example includes potassium aluminum sulfate octadecahydrate. Alternatively, the metal complex can include two or more central atoms, also referred to as polynuclear complexes, which can be formed when a ligand donates electron pairs to two or more metal ions simultaneously and then acts as bridge between the multiple central ions. In some examples, the charged complex ions can be octa-aquo-dioxodialuminim $(iV)^{4+}$, $Al_8(OH)_{20}{}^{4+}$ or $[Al_8(OH)_{10}(SO_4)_5]^{4+}$. Other types of multivalent metal salts without similar complex structure as described above may also be used to similar effect. For example, aluminum fluorosulfate and aluminum chloride can also be used. The inclusion of one of these salts or other similar salt can improve the print quality and optical density of printed areas on fabrics.

The water-soluble high-valence metal complex can be a water-soluble cationic polymeric compound containing high-valence metallic ion. Examples of such cationic polymer include: poly-diallyldimethylammonium chloride, polydiallylamine, polyethylene imine, poly2-vinylpyridine, poly 4-vinylpyridine poly2-(tert-butylamino)ethyl methacrylate, poly 2-aminoethyl methacrylate hydrochloride, poly 4'-diamino-3,3'-dinitrodiphenyl ether, poly N-(3-aminopropyl)methacrylamide hydrochloride, poly 4,3,3'-diaminodiphenyl sulfone, poly 2-(iso-propylamino)ethylstyrene, poly2-(N,N-diethylamino)ethyl methacrylate, poly 2-(diethylamino)ethylstyrene, and 2-(N,N-dimethylamino) ethyl acrylate, to name a few.

The water-soluble high-valence metal complex, as defined herein, present in the coating composition that is applied to the fabric base substrate, can be used in an amount representing from about 0.1 wt % to about 30 wt % (dry weight), or from about 0.5 wt % to about 25 wt % (dry weight), or from about 1 wt % to about 20 wt % (dry weight), by total dry weight of the coating composition.

Polymeric Particle

The coating composition, that is applied to the fabric base substrate, can, optionally, include polymeric particles. Such polymeric particles can be considered as organic beads. In some examples, the polymeric particle is a poly-alkene compound. By poly-alkene compound, it is meant herein that the polymeric particle is made, for instance, from a poly-alkene homopolymer, a poly-alkene copolymer, a modified poly-alkene, a combination of two or more of the above-listed poly-alkenes, or a mixture of two or more thereof. By definition, a "poly-alkene" herein refers to a polymeric material formed via polymerization of an alkene monomer, i.e., $C_nH_{2n}$ and its derivatives, where n is within a range of about 7,000 to about 20,000. Examples of the polymers used to make the polymeric particles include, but are not limited to, polyethylene homopolymer, polypropylene homopolymer, polytetrafluoroethylene (PTFE), polyamide, amide-modified polyethylene, amide-modified polypropylene, PTFE-modified polyethylene, PTFE-modified polypropylene, maleic anhydride-modified polyethylene, maleic anhydride-modified polypropylene, oxidized polyethylene, oxidized polypropylene, chloride polyethylene, chloride polypropylene, a combination of two or more of the above-listed poly-alkenes, or a mixture of two or more of the above-listed poly-alkenes. The polymeric particles can have a hardness value less than about 2 dmm, as measured by ASTM D-5 method. In some other examples, the particles have a hardness value less than about 1, or less than about 0.5 dmm. In some examples, the particle size of the polymeric particles can be in the range of about 10 to about 40 μm.

In some examples, the polymeric particles are a polytetrafluoroethylene (PTFE), polyamide or polyethylene polymer particles. In some other examples, the polymeric particles are polytetrafluoroethylene (PTFE), polyamide or polyethylene polymer particles and have an average particle size be in the range of about 10 to about 60 μm. In yet some other examples, the polymeric particles are polyamide polymer particles. The polymeric particles can thus be polyamide particles that have a Vicat softening point ranging from about 100° C. to about 180° C., as measured by the Industrial standard ASTM D1525, and have a melting point ranging from about 100° C. to about 220° C., as measured by the industrial standard IS03146.

Polymeric particles are rigid and temperature-resistant particles. The "temperature-resistant" refers to the fact that the change in the rigidness will be kept substantially minimal under the fabric manufacture and storage conditions, even if polymeric particles can be made from the thermoplastic and thermoset polymers. In addition, polymeric particles will not change its morphology (such as melting, collapse, and coalescence together) under printing condition. The temperature-resistant of the polymeric particles could be monitored by its softening temperature as defined and measured by the industrial standard ASTM D6493 or ISO 4625. In some examples, the softening temperature of the polymeric particle is greater than 120° C. or in the temperature range of about 130° C. to about 200° C. Without being linked by any theory, with said chemical and physical characteristics, the polymeric particles are thought to provide a high durability (especially high anti-abrasion capability) to the printed image.

The polymeric particle can be available under the tradename Organsol® 2002 ES3 NAT3 (available from Arkema) or under the tradename Slip Ayd SL300 (available from Elementis Specialties).

The polymeric particle can be present, in the fabric print medium, in an amount representing more than 1 wt % by total weight of the fabric print medium. In some examples, the amount of polymeric particle, in the print medium, can be within the range of about 0.5 to about 30 wt % or within the range of about 1 to about 20 wt % or within the range of about 1 to about 15 wt % by total weight of the fabric print medium. In some other examples, the polymeric particles are present, in the coating composition, in an amount representing from about 10 to about 30 wt % of the total weight of the coating composition.

Method for Forming a Fabric Print Medium

The fabric print medium is prepared by using a surface treatment composition herein named a coating layer or coating composition. A method for forming the fabric print medium, according to the present disclosure, encompasses providing a fabric base substrate; impregnating said fabric base substrate with a coating composition to form a coating layer, said composition including a non-halogenated flame retardant agent having phosphorous-containing ingredient and nitrogen-containing ingredient compounded at a 1:1 ratio, a water-soluble polymer binder and a water-soluble high-valence metal complex; and drying the fabric substrate under heat to form a fabric print medium.

The coating compositions can be prepared in a liquid carrier in order to disperse or solubilize coating composition components. Such liquid carrier is, for example, an aqueous solvent such as water and low boiling point alcohol. The liquid carrier can be removed, at least in part, from the final product once the coating composition is applied to the fabric. The liquid carrier may include water, co-solvents, surfactants, viscosity modifying agents, inorganic ingredients, pH control agents and/or deformers. The primary function of the carrier is to dissolve/disperse and/or carry the solids or other components that remain on the fabric as a coating, and to provide a carrier that will suitably carry all the components in the composition and help them uniformly distribute on the fabric base surface. There is no specific limitation on selection of the carrier components, as long as the carrier as a whole has the function described above.

The application of the coating composition to the fabric base substrate can be carried out using padding procedures. The fabric substrate can be soaked in a bath and the excess can be rolled out. More specifically, impregnated fabric substrates (prepared by bath, spraying, dipping, etc.) can be passed through padding nip rolls under pressure to provide a dry picked up from about 0.5 to about 50 gsm, though this range is not limiting. The impregnated fabric, after nip rolling, can then be dried under heat at any functional time which is controlled by machine speed with peak fabric web temperature in the range of about 90° C. to about 180° C. In some examples, pressure can be applied to the fabric substrate after impregnating the fabric base substrate with the coating composition. In some other examples, the surface treatment is accomplished in a pressure padding operation. During such operation, the fabric base substrate is firstly dipped into a pan containing treatment coating composition and is then passed through the gap of padding rolls. The padding rolls (a pair of two soft rubber rolls or a metal chromic metal hard roll and a tough-rubber synthetic soft roll for instance), apply the pressure to composite-wetted textile material so that composite amount can be accurately controlled. In some examples, the pressure, that is applied, is between about 10 and about 150 PSI or, in some other examples, is between about 30 to about 70 PSI.

The dry amount of the coating layer composition, that is applied to the fabric base substrate, can be in the range of about 0.1 to about 40 gram per square meter (gsm) or in the range of about 0.5 gsm to about 30 gsm, or in the range of about 3 to about 20 gsm, or in the range of about 5 to about 15 gsm. In some examples, the coat weight of the coating composition that is applied to the fabric base substrate is between 5 and 20 gsm.

The coating composition can be dried using box hot air dryer. The dryer can be a single unit or could be in a serial of 3 to 7 units so that a temperature profile can be created with initial higher temperature (to remove excessive water) and mild temperature in end units (to ensure completely drying with a final moisture level of less than 1-5% for example). The peak dryer temperature can be programmed into a profile with higher temperature at begging of the drying when wet moisture is high and reduced to lower temperature when web becoming dry. The dryer temperature is controlled to a temperature of less than about 200° C. to avoid yelling textile, and the fabric web temperature is controlled in the range of about 90 to about 180° C. In some examples, the operation speed of the padding/drying line is 50 yards per minute.

Printing Method

Once the coating composition is applied to the fabric base substrate and appropriately dried, ink compositions can be applied by any processes onto the fabric print medium. In some examples, the ink composition is applied to the fabric print medium via inkjet printing techniques. The printing method encompasses obtaining a fabric print medium containing a fabric base substrate and a coating composition applied to said fabric base substrate, said coating composition including a non-halogenated flame retardant agent having phosphorous-containing ingredient and nitrogen-containing ingredient compounded at a 1:1 ratio, a water-soluble polymer binder and a water-soluble high-valence metal complex; and, then, applying an ink composition onto said fabric print medium to form a printed image. Said printed image will have, for instance, enhanced image quality and image permanence. In some examples, when needed, the printed image can be dried using any drying device attached to a printer such as, for instance, an IR heater.

In some examples, the ink composition is an inkjet ink composition that contains one or more colorants that impart the desired color to the printed message and a liquid vehicle. As used herein, "colorant" includes dyes, pigments, and/or other particulates that may be suspended or dissolved in an ink vehicle. The colorant can be present in the ink composition in an amount required to produce the desired contrast and readability. In some examples, the ink compositions include pigments as colorants. Pigments that can be used include self-dispersed pigments and non-self-dispersed pigments. Any pigment can be used; suitable pigments include black pigments, white pigments, cyan pigments, magenta pigments, yellow pigments, or the like. Pigments can be organic or inorganic particles as well known in the art. As used herein, "liquid vehicle" is defined to include any liquid composition that is used to carry colorants, including pigments, to a substrate. A wide variety of liquid vehicle components may be used and include, as examples, water or any kind of solvents.

In some other examples, the ink composition, applied to fabric print medium, is an ink composition containing latex components. Latex components are, for examples, polymeric latex particulates. The ink composition may contain polymeric latex particulates in an amount representing from about 0.5 wt % to about 15 wt % based on the total weight of the ink composition. The polymeric latex refers herein to a stable dispersion of polymeric micro-particles dispersed in the aqueous vehicle of the ink. The polymeric latex can be natural latex or synthetic latex. Synthetic latexes are usually produced by emulsion polymerization using a variety of initiators, surfactants and monomers. In various examples, the polymeric latex can be cationic, anionic, nonionic, or amphoteric polymeric latex. Monomers that are often used to make synthetic latexes include ethyl acrylate; ethyl methacrylate; benzyl acrylate; benzyl methacrylate; propyl acrylate; methyl methacrylate, propyl methacrylate; iso-propyl acrylate; iso-propyl methacrylate; butyl acrylate; butyl methacrylate; hexyl acrylate; hexyl methacrylate; octadecyl methacrylate; octadecyl acrylate; lauryl methacrylate; lauryl acrylate; hydroxyethyl acrylate; hydroxyethyl methacrylate; hydroxyhexyl acrylate; hydroxyhexyl methacrylate; hydroxyoctadecyl acrylate; hydroxyoctadecyl methacrylate; hydroxylauryl methacrylate; hydroxylauryl acrylate; phenethyl acrylate; phenethyl methacrylate; 6-phenylhexyl acrylate; 6-phenylhexyl methacrylate; phenyllauryl acrylate; phenyllauryl methacrylate; 3-nitrophenyl-6-hexyl methacrylate; 3-nitrophenyl-18-octadecyl acrylate; ethyleneglycol dicyclopentyl ether acrylate; vinyl ethyl ketone; vinyl propyl ketone; vinyl hexyl ketone; vinyl octyl ketone; vinyl butyl ketone; cyclohexyl acrylate; methoxysilane; acryloxypropyhiethyldimethoxysilane; trifluoromethyl styrene; trifluoromethyl acrylate; trifluoromethyl methacrylate; tetrafluoropropyl acrylate; tetrafluoropropyl methacrylate; heptafluorobutyl methacrylate; butyl acrylate; iso-butyl methacrylate; 2-ethylhexyl acrylate; 2-ethylhexyl methacrylate; isooctyl acrylate; and iso-octyl methacrylate.

In some examples, the latexes are prepared by latex emulsion polymerization and have an average molecular weight ranging from about 10,000 Mw to about 5,000,000 Mw. The polymeric latex can be selected from the group consisting of acrylic polymers or copolymers, vinyl acetate polymers or copolymers, polyester polymers or copolymers, vinylidene chloride polymers or copolymers, butadiene polymers or copolymers, polystyrene polymers or copolymers, styrene-butadiene polymers or copolymers and acrylonitrile-butadiene polymers or copolymers.

The latex components are on the form of a polymeric latex liquid suspension. Such polymeric latex liquid suspension can contain a liquid (such as water and/or other liquids) and polymeric latex particulates having a size ranging from about 20 nm to about 500 nm or ranging from about 100 nm to about 300 nm.

EXAMPLES

Ingredients

TABLE 1

| Ingredient name | Nature of the ingredients | Supplier |
|---|---|---|
| Aflammit ®MSG | Non-halogenated flame retardant agent with phosphorus and nitrogen ingredients | Thor |
| Eagleban ® FRA-4117 | Dispersed solid flame retardant | Eagle Performance products |
| Raycat ®78 | non-film forming polyacrylic emulsion polymer | Specialty Polymers |
| Raycat ®100 | non-film forming polyacrylic emulsion polymer | Specialty Polymers |
| FR-102 | Flame retardant | Shanghai Xuesh |
| Aflammit ® PE | Phosphorus nitrogen flame retardant | Thor |
| Aluminum sulfate octadeca hydrate | High-valence metallic salt | Aldrich Inc. |
| Slid Ady ® SL 300 | Dispersed non-deformable polymer | Elementis Specialties |
| PrintRite ®DP376 | Water-soluble polymer binder | Lubrizol |
| Organsol ®2002 ES3 NAT3 | Polymeric particle | Arkema |

Example 1—Preparation of Print Medium

A substrate made of 100% woven polyester, with a poplin weave structure, having a weight of 170 gsm is used as fabric base substrate. Different coating compositions (1-10), as formulated in Table 2, are applied to said fabric base substrate. The coating layer compositions are formulated using a lab mixer of about 1 Liter batch size, at room temperature, according to the formulation (in parts by weight) summarized in Table 2. The final solution is adjusted by adding deionized water to solids content of 3% by weight. Compositions 4, 8 and 10 are formulated according to the principles described herein; compositions 1, 2, 3, 5, 6, 7 and 9 are comparative examples. The individual solids components are provided in dry parts by weight (dry wt %).

The fabric substrates are impregnated using the coating compositions 1 to 10 of Table 2 and passed through padding nip rollers with a nip pressure about 70 PSI to achieve a wet pick up of from 40 to 60%. The impregnated substrates are then dried in a convection oven at 100° C. to 180° C. with a drying speed of 6 feet per minute in view of obtaining the sample fabric substrates EX 1 to EX 10. Each of sample fabric substrates EX 1 to EX 10 has a coating layer of about 10 gsm.

TABLE 2

| | Compositions | | | | | | | | | |
|---|---|---|---|---|---|---|---|---|---|---|
| Ingredients | 1 | 2 | 3 | 4 | 5 | 6 | 7 | 8 | 9 | 10 |
| Aflammit ® MSG | 20 | 30 | 50 | 70.6 | — | — | — | 63.2 | 100 | 60 |
| FRA 4117 | 20 | 20 | — | — | — | 70.6 | — | — | — | — |
| Raycat ®78 | 34 | 34 | 34 | — | — | — | — | — | — | — |
| Raycat ®100 | 5 | 5 | 5 | — | — | — | — | — | — | — |
| FR-102 | — | — | — | — | 70.5 | — | — | — | — | — |
| Aflammit ® PE | — | — | — | — | — | — | 70.6 | — | — | — |
| Aluminum sulfate | 5 | 5 | 5 | 5.9 | 5.9 | 5.9 | 5.9 | 5.3 | — | 10 |
| Slid Ady ®SL 300 | 16 | 16 | 16 | — | — | — | — | — | — | — |
| PrintRite ®DP376 | — | — | — | 23.5 | 23.5 | 23.5 | 23.5 | 21 | — | 10 |
| Organsol ®2002 ES3 NAT3 | — | — | — | — | — | — | — | 10.5 | — | 20 |

Example 2—Image Quality and Fabric Print Medium Performances

Once the fabric print mediums are prepared, identical image sequences are printed on said fabric print mediums (EX1 to EX10) using a HP DesignJet L260 Printer equipped with HP 792 ink cartridges. The printer is set with a heating zone temperature at about 50° C., a cure zone temperature at about 110° C. and an air flow at about 45%. Image quality, ink adhesion and fire retardancy are evaluated on the printed images. The results are illustrated in the Table 3 below.

Image quality tests are conducted by measuring parameters such as color gamut. Gamut Measurement represents the amount of color space covered by the ink on the media sample (a measure of color richness). The gamut is measured on Macbeth® TD904 (Macbeth Process measurement). A higher value indicates better color richness.

Ink adhesion tests are carried out for rub resistance. Rub resistance testing is carried out using an abrasion scrub tester (per ASTM D4828 method): fabrics are printed with small patches of all available colors (cyan, magenta, yellow, black, green, red, and blue). A weight of 250 g is loaded on the test header. The test tip is made of acrylic resin with crock cloth. The test cycle speed is 25 cm/min and 5 cycles are carried out for each sample at an 8 inch length for each cycle. The test probe is in dry (dry rub) or wet (wet rub) mode. The damage on the image is evaluated visually using a scale of 1-5 (with 1 being the worst and 5 being the best).

Fire retardancy is evaluated by Diversified Test Lab Inc., complying with FR NFPA 701 standard and is also evaluated by Hewlett Packard's internal test with CA 1237 standard. The printed samples either pass or fail the tests.

TABLE 3

| | Ink adhesion | | Color | Fire retardancy | |
|---|---|---|---|---|---|
| Sample ID | Dry rub | Wet rub | Gamut | NFPA701 | CA1237 |
| EX 1(comparative) | 4 | 3 | 236K | fail | fail |
| EX 2 (comparative) | 4 | 3 | 213K | fail | fail |
| EX 3 (comparative) | 4 | 3 | 237K | fail | fail |
| EX 4 | 3.75 | 3 | 240K | pass | pass |
| EX 5 (comparative) | 3 | 2 | 230K | pass | fail |
| EX 6 (comparative) | 3 | 2 | 210K | pass | fail |
| EX 7 (comparative) | 3 | 2 | 235K | pass | fail |
| EX 8 | 4 | 3 | 237K | pass | pass |
| EX 9 (comparative) | 3 | 2 | 240K | pass | pass |
| EX 10 | 5 | 3.5 | 245K | pass | pass |

As can be seen by the test results above, the fabric print medium according to the present disclosure provides several advantages over the comparative samples in terms of image quality, durability resistance and fire retardancy. It is noted that though some comparative medium performed well in some categories, they performed poorly in others. In accordance with examples of the present disclosure, over all of these tests, performance is collectively better when using the fabric print medium described herein.

The invention claimed is:

1. A fabric print medium including a fabric base substrate and a coating composition, applied to said fabric base substrate, that comprises:

a. a non-halogenated flame retardant agent having phosphorous-containing ingredient and nitrogen-containing ingredient compounded at a 1:1 ratio;

b. a water-soluble polymer binder;

c. and a water-soluble multi-valence metal complex.

2. The fabric print medium of claim 1 wherein the coating composition forms a layer having a coat-weight in the range of about 0.1 to about 40 gsm per side.

3. The fabric print medium of claim 1 wherein the non-halogenated flame retardant agent is present, in the coating composition, in an amount representing from about 40 to about 90 wt % of the total weight of the coating composition.

4. The fabric print medium of claim 1 wherein the non-halogenated flame retardant agent has a methyl-phosphonic acid [$(CH_3)PO(OH)_2$)] as phosphorous-containing ingredient and an amidourea group [$(NH_2)(NH)CO(NH_2)$] as nitrogen-containing ingredient.

5. The fabric print medium of claim 1 wherein the non-halogenated flame retardant agent is selected from the group consisting of ammonium polyphosphate, poly(4,4-diaminodiphenyl methane spirocyclic pentaerythritol bisphosphonate), 1,4-di(diethoxy thiophosphamide benzene, aminomethyl phosphonate, ethylenediamine-o-phosphate, modified guanidine phosphate, melamine phosphate, melamine polyphosphate and melamine-poly(ammonium) phosphate.

6. The fabric print medium of claim 1 wherein the water-soluble polymer binder is selected from the group consisting of polyurethane, polyvinyl alcohol, polyvinyl acetate, starches and chemically modified starches.

7. The fabric print medium of claim 1 wherein the coating composition further comprises polymeric particles.

8. The fabric print medium of claim 1 wherein the coating composition further comprises poly-alkene polymeric particles.

9. The fabric print medium of claim 1 wherein the coating composition further comprises polymeric particles that are polytetrafluoroethylene (PTFE), polyamide or polyethylene polymer and that have a particle size be in the range of about 10 to about 60 μm.

10. The fabric print medium of claim 1 wherein the fabric base substrate is woven, knitted, non-woven or tufted and comprises natural or synthetic fibers selected from the group consisting of wool, cotton, silk, rayon, thermoplastic aliphatic polymers, polyesters, polyamides, polyimides, polypropylene, polyethylene, polystyrene, polytetrafluoroethylene, fiberglass, polycarbonates polytrimethylene terephthalate, polyethylene terephthalate and polybutylene terephthalate.

11. The fabric print medium of claim 1 wherein the fabric base substrate is a synthetic polyester fiber.

12. The fabric print medium of claim 1 wherein, in the coating composition, the water-soluble multi-valence metal complex is a water-soluble aluminum salt.

13. A method for forming a fabric print medium comprising:

a. providing a fabric base substrate;

b. impregnating said fabric base substrate with a coating composition to form a coating layer, said composition including a non-halogenated flame retardant agent having phosphorous-containing ingredient and nitrogen-containing ingredient compounded at a 1:1 ratio, a water-soluble polymer binder and a water-soluble multi-valence metal complex;

c. drying the fabric substrate under heat to form a fabric print medium.

14. A printing method comprising:

a. obtaining a fabric print medium with a fabric base substrate and a coating composition applied to said substrate, the coating composition including a non-halogenated flame retardant agent having phosphorous-containing ingredient and nitrogen-containing ingredient compounded at a 1:1 ratio, a water-soluble polymer binder and a water-soluble multi-valence metal complex;

b. and applying an ink composition onto said fabric print medium to form a printed image.

15. The printing method of claim 14 wherein the ink composition is an ink composition containing latex components.

16. The fabric print medium of claim 1 wherein the water-soluble polymer binder is present, in the coating composition, in an amount representing from about 2 wt % to about 30 wt % of a total weight of the coating composition.

17. The fabric print medium of claim 1 wherein the water-soluble multi-valence metal complex is present, in the coating composition, in an amount representing from about 0.1 wt % to about 30 wt % (dry weight) of a total dry weight of the coating composition.

18. The fabric print medium of claim 1 wherein:

the fabric base is woven polyester;

the non-halogenated flame retardant agent is present, in the coating composition, in an amount representing about 70.6 wt % of a total dry weight of the solids of the coating composition;

the water-soluble polymer binder is present, in an amount representing about 23.5 wt % of the total dry weight of the solids of the coating composition;

the water-soluble multi-valence metal complex is aluminum sulfate; and the water-soluble multi-valence metal complex is present, in the coating composition, in an amount representing about 5.9 wt % of the total dry weight of the solids of the coating composition.

19. The fabric print medium of claim 1 wherein:

the fabric base is woven polyester;

the non-halogenated flame retardant agent is present, in the coating composition, in an amount representing about 63.2 wt % of a total dry weight of the solids of the coating composition;

the water-soluble polymer binder is present, in an amount representing about 21 wt % of the total dry weight of the solids of the coating composition;

the water-soluble multi-valence metal complex is aluminum sulfate;

the water-soluble multi-valence metal complex is present, in the coating composition, in an amount representing about 5.3 wt % of the total dry weight of the solids of the coating composition;

the coating composition further comprises polymeric particles; and the polymeric particles are present, in the coating composition, in an amount representing about 10.5 wt % of the total dry weight of the solids of the coating composition.

20. The fabric print medium of claim 1 wherein:

the fabric base is woven polyester;

the non-halogenated flame retardant agent is present, in the coating composition, in an amount representing about 60 wt % of a total dry weight of the solids of the coating composition;

the water-soluble polymer binder is present, in an amount representing about 10 wt % of the total dry weight of the solids of the coating composition;

the water-soluble multi-valence metal complex is aluminum sulfate;

the water-soluble multi-valence metal complex is present, in the coating composition, in an amount representing about 10 wt % of the total dry weight of the solids of the coating composition;

the coating composition further comprises polymeric particles; and the polymeric particles are present, in the coating composition, in an amount representing about 20 wt % of the total dry weight of the solids of the coating composition.

* * * * *